US007316051B2

(12) United States Patent
Budd

(10) Patent No.: US 7,316,051 B2
(45) Date of Patent: Jan. 8, 2008

(54) SUCTION NOZZLE HEIGHT ADJUSTMENT CONTROL CIRCUIT

(75) Inventor: Andrew C. Budd, Uniontown, OH (US)

(73) Assignee: The Hoover Company, North Canton, OH (US)

( * ) Notice: Subject to any disclaimer, the term of this patent is extended or adjusted under 35 U.S.C. 154(b) by 504 days.

(21) Appl. No.: 10/882,823

(22) Filed: Jul. 1, 2004

(65) Prior Publication Data

US 2006/0000052 A1 Jan. 5, 2006

(51) Int. Cl.
*A47L 9/28* (2006.01)

(52) U.S. Cl. ..... 15/361; 15/354; 15/319

(58) Field of Classification Search ..... 15/354–356, 15/361–362, 319
See application file for complete search history.

(56) References Cited

U.S. PATENT DOCUMENTS 2,734,217 A 2/1956 Brace
4,706,327 A * 11/1987 Getz et al. ..... 15/319
5,477,587 A 12/1995 Glenn, III et al.
2002/0129461 A1 9/2002 Wegelin et al.
2006/0130270 A1* 6/2006 Tondra et al. ..... 15/354

* cited by examiner

*Primary Examiner*—Theresa T. Snider
(74) *Attorney, Agent, or Firm*—A. Burgess Lowe

(57) ABSTRACT

A floor care appliance is provided with a switch for controlling the height of the suction nozzle. The switch controls the height of the suction nozzle by controlling the operation of an independent motor and a gear and cam arrangement operatively connected to the wheel carriage. Another cam arrangement is operatively connected to the independent motor which engages suction nozzle height adjustment travel limits at both extremes of the suction nozzle height. The suction nozzle height adjustment travel limit switches turn off current to the independent motor at the extremes of the suction nozzle height to prevent overheating of the independent motor and over travel. In the preferred embodiment of the invention, two wires connect the suction nozzle height control switch to the independent motor along with the two travel limit switches and a pair of diodes. In an alternate embodiment of the invention, three wires connect the suction nozzle height control switch to the independent motor along with the two travel limit switches.

12 Claims, 6 Drawing Sheets

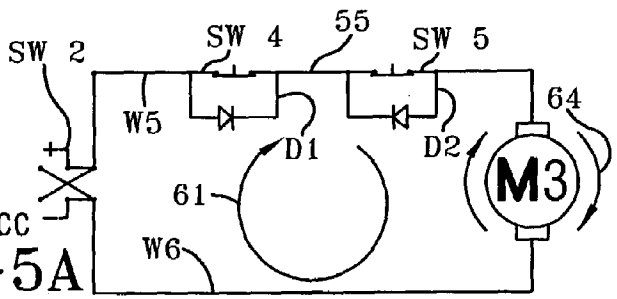
FIG-5A
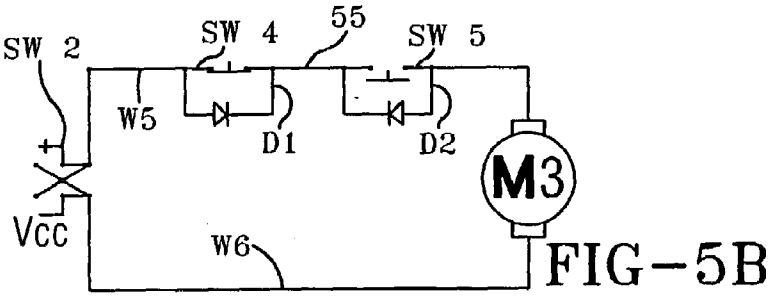
FIG-5B
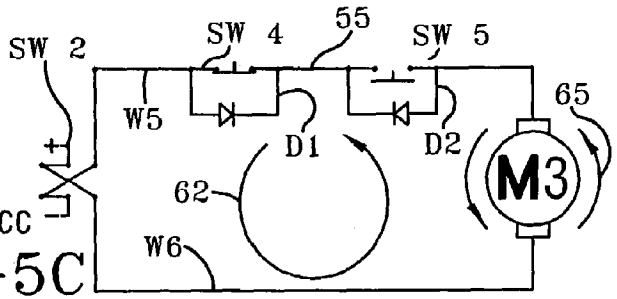
FIG-5C
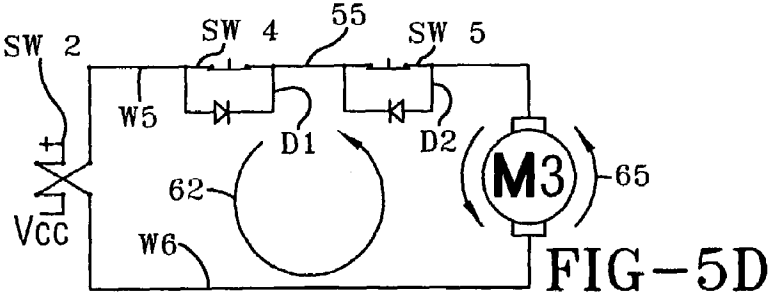
FIG-5D
FIG-5E
FIG-5F

SUCTION NOZZLE HEIGHT ADJUSTMENT CONTROL CIRCUIT

BACKGROUND OF THE INVENTION

1. Field of the Invention

This invention relates to floor care appliances, and more specifically, to a floor care appliance having a suction nozzle height adjustment arrangement that has electronic height adjustment travel limit stops.

2. Summary of the Prior Art

Floor care appliances are well known in the art. Typical floor care appliances include upright vacuum cleaners, canister vacuum cleaners, hard floor cleaners, and extractors. More recently floor care appliances have been provided with an electric motor to adjust the height of the suction nozzle according to the user's desires. A switch is typically located on the cleaner handle to raise and lower the suction nozzle. However, such an arrangement can possibly damage the electric motor or the drive train assembly connected to the electric motor which is used to raise and lower the suction nozzle when the suction nozzle is at the extremes of the height ranges. It is unknown to provide such an arrangement with suction nozzle height adjustment stops which turn off the electric motor when the suction nozzle is at the extremes of the height ranges.

Also known in the art is to use a wire harness to connect the switch to the electric height adjustment motor. Such a harness usually requires a minimum of four wires to switch and power the electric motor in both directions. However, one or two wires can be eliminated by the use of a wire harness and diode arrangement. Therefore, the present invention fulfills a need not addressed heretofore in the art.

SUMMARY OF THE INVENTION

In the preferred embodiment of the present invention, a switch on the cleaner handle is provided to control the height of the suction nozzle by controlling an independent nozzle height adjustment motor. The height adjustment motor is operatively connected through gearing to a cylindrical cam which urges a wheel carriage towards the floor surface to raise the suction nozzle height. Alternately, when the cam is rotated in the opposite direction, the cylindrical cam releases pressure from the wheel carriage and the weight of the suction nozzle causes the suction nozzle to be lowered towards the floor surface. An additional suction nozzle height adjustment travel limit cam arrangement is provided at the top of the cylindrical cam arrangement to engage one or more suction nozzle height limit switches which shut off the height adjustment motor at the extreme limits of travel of the height of the suction nozzle. As the suction nozzle is moved to either of the highest position or the lowest position, the travel limit cam is rotated into engagement with the high position travel limit switch or the low position travel switch, respectively. When either of the high position travel limit switch or the low position travel switch is engaged, the suction nozzle height adjustment motor is de-energized preventing the motor from overheating and protecting the gear and cam assembly. In the preferred embodiment of the present invention, the high and low suction nozzle height adjustment travel limit switches are operatively connected to the suction nozzle height adjustment motor by two wires and a diode is placed in parallel with each of the travel limit switches. The diodes allow the suction nozzle height adjustment motor to run momentarily after the suction nozzle has been moved to one of the opposite extremes of travel and the respective travel limit switches has been opened. The diode allows current to flow despite the travel limit switch being open so that the height adjustment motor is energized once the height adjustment switch on the handle is moved in the opposite direction. Once the suction nozzle height adjustment motor has been momentarily energized the travel limit cam arrangement is moved away from the travel limit switch and the circuit returns to normal operation.

In an alternate embodiment of the present invention, three wires are used for connecting the suction nozzle height adjustment switch to the suction nozzle height adjustment motor. The high and low suction nozzle height adjustment travel limit switches are located along two of the wires so that when one of the travel limit switches is opened, the other is closed so that there is still a closed circuit to operate the suction nozzle height adjustment motor when the suction nozzle height adjustment switch is moved in the opposite direction.

In yet another alternate embodiment of the present invention, the suction nozzle height adjustment travel limit switches can be replaced with a potentiometer which can sense the exact position of the suction nozzle height to control the suction nozzle height adjustment motor and turn it off at the limits of travel. This can be done through a variety means including inputting a voltage from the potentiometer to a circuit which turns off the suction nozzle height adjustment motor when the appropriate voltage is sensed. Or the voltage could be input to a microprocessor which controls the suction nozzle height adjustment motor when a particular voltage is sensed.

In yet still another alternate embodiment of the present invention, more than two suction nozzle height adjustment travel limit switches could be used to provide position information to a circuit or a microprocessor controlling the operation of the suction nozzle height adjustment motor. As the suction nozzle is moved through the various height positions, the suction nozzle height adjustment travel limit cam is rotated and engages one of the various travel limit switches providing the position information. The travel limit switches at the extremes of the suction nozzle height positions are used to shut off the current to the suction nozzle height adjustment motor to prevent overheating and damage to the suction nozzle height gear and cam assembly.

Accordingly, it is an object of the invention to provide a floor care appliance having a suction nozzle wherein the height is adjustable.

It is a further object of this invention to provide a floor care appliance having a suction nozzle wherein the height is adjustable by an independent suction nozzle height adjustment motor.

It is yet still a further object of this invention to provide a floor care appliance having a suction nozzle wherein the height is adjustable by an independent suction nozzle height adjustment motor which is controlled by a switch.

It is still yet a further object of this invention to provide a floor care appliance having a suction nozzle wherein the height is adjustable by an independent suction nozzle height adjustment motor and suction nozzle height adjustment travel limit switches turn off the suction nozzle height adjustment motor at the extremes of travel of the suction nozzle height.

It is an object of this invention to provide a floor care appliance having a suction nozzle wherein the height is adjustable by an independent suction nozzle height adjustment motor and suction nozzle height adjustment travel limit switches turn off the suction nozzle height adjustment motor at the extremes of travel of the suction nozzle height.

It is yet still a further object of this invention to provide a floor care appliance having a suction nozzle wherein the height is adjustable by an independent suction nozzle height adjustment motor which is controlled by a switch and the switch is connected to the suction nozzle height adjustment motor by two wires, a pair of suction nozzle height adjustment travel limit switches, and a two diodes.

It is still yet a further object of this invention to provide a floor care appliance having a suction nozzle wherein the height is adjustable by an independent suction nozzle height adjustment motor which is controlled by a switch and the switch is connected to the suction nozzle height adjustment motor by three wires and a pair of suction nozzle height adjustment travel limit switches.

It is still yet a further object of this invention to provide a floor care appliance having a suction nozzle wherein the height is adjustable by an independent suction nozzle height adjustment motor which is controlled by a switch and a potentiometer is utilized to sense the position of the suction nozzle and turn off the suction nozzle height adjustment motor at the extremes of travel of the suction nozzle height.

It is an object of the invention to provide a floor care appliance having a suction nozzle wherein the height is adjustable by an independent suction nozzle height adjustment motor which is controlled by a switch and three or more travel limit switches are utilized to sense the position of the suction nozzle and two of the travel limit switches are used to turn off the suction nozzle height adjustment motor at the extremes of travel of the suction nozzle height.

BRIEF DESCRIPTION OF THE DRAWINGS

Reference may now be had to the accompanying drawings for a better understanding of the invention, both as to its organization and function, with the illustration being only exemplary and in which:

FIGS. 5A-5F show a circuit for controlling an electric motor in both directions for raising and lowering a suction nozzle utilizing two wires between the control switch and the electric motor, according to the preferred embodiment of the present invention.

DETAILED DESCRIPTION OF THE INVENTION

Figure 1:
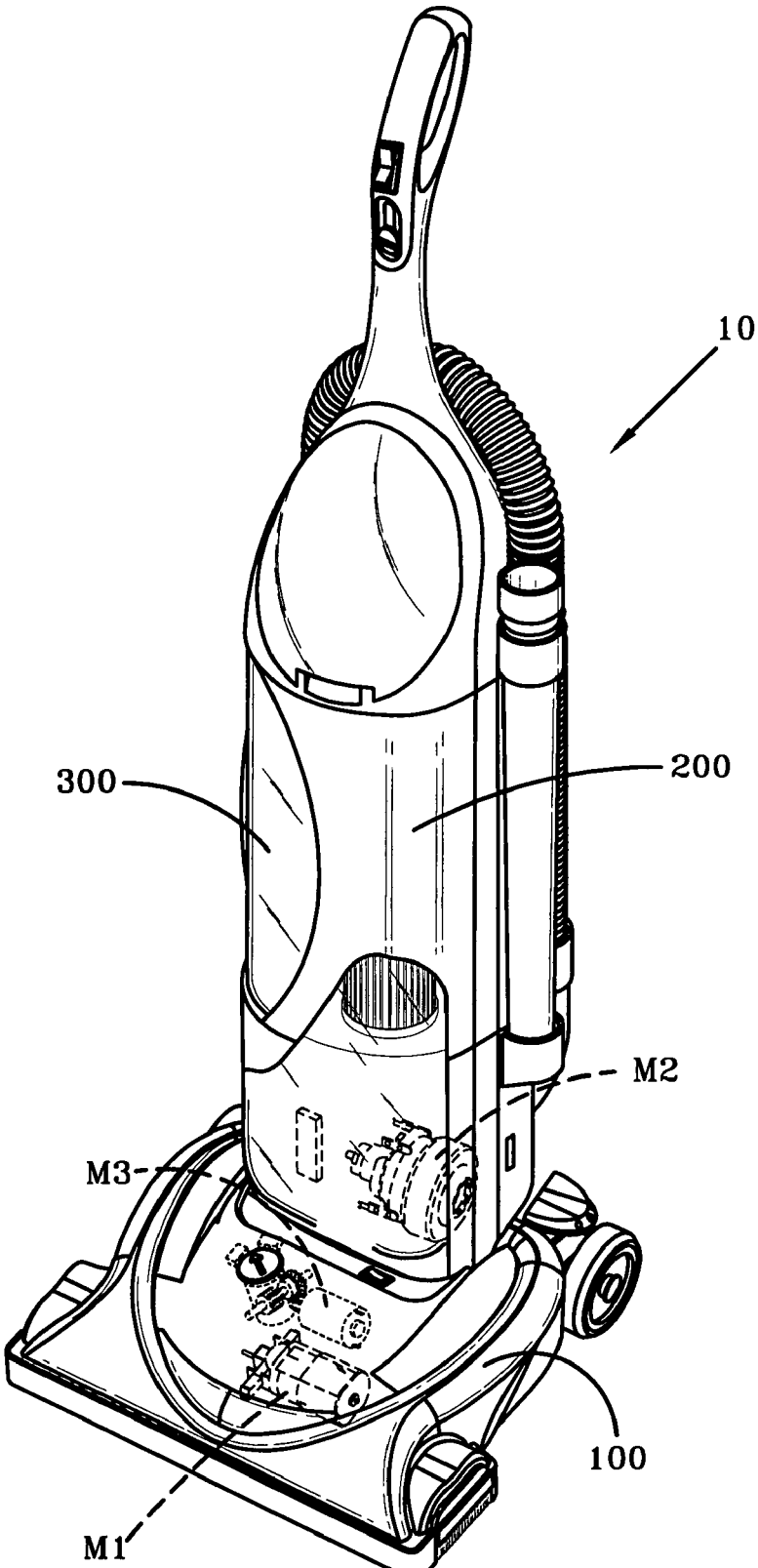
FIG. 1 is a perspective view of a floor care appliance having an automatic nozzle height adjustment arrangement, according to the preferred embodiment of the present invention.
Figure 2:
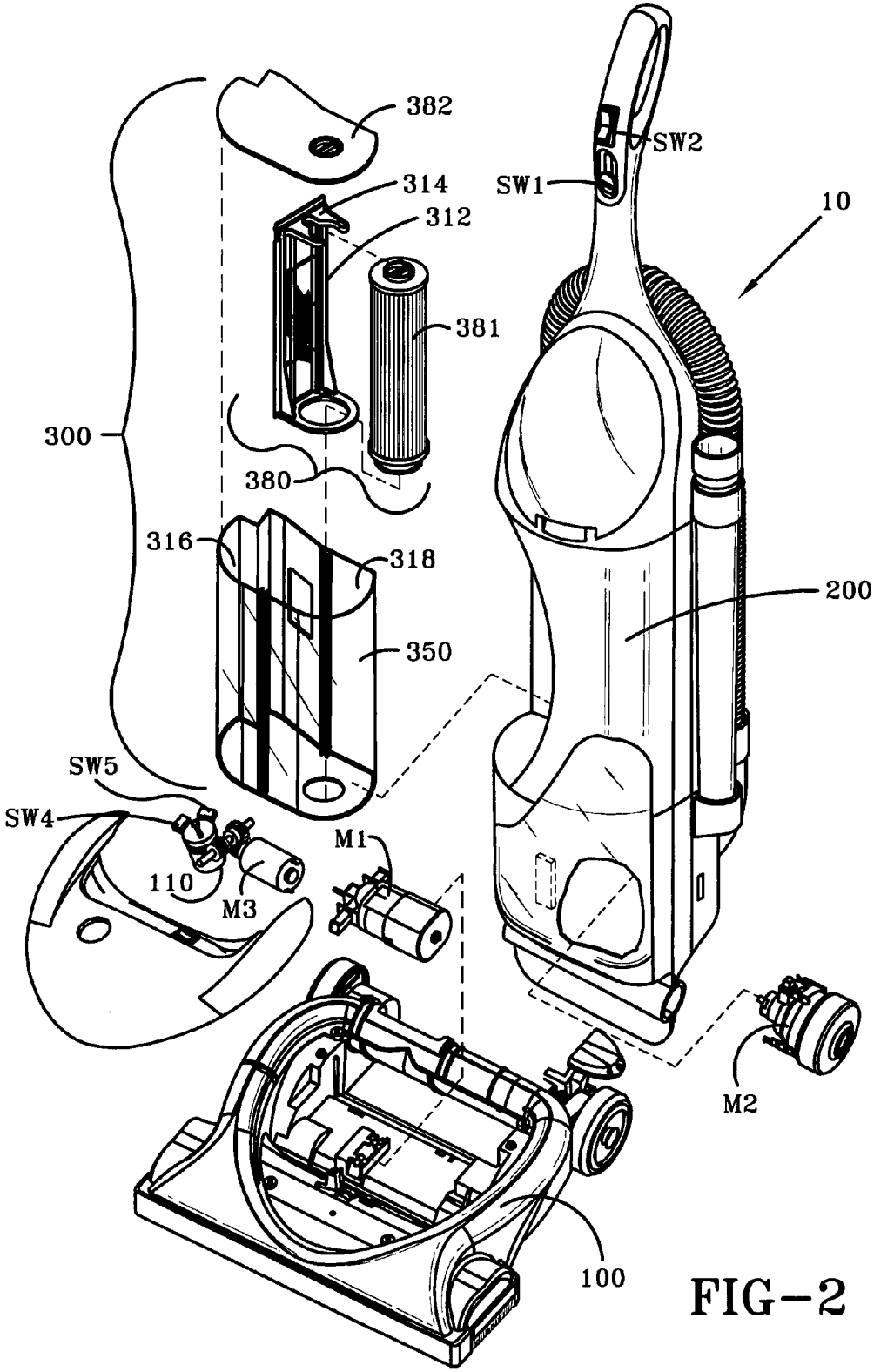
FIG. 2 is an exploded view of a floor care appliance having a having an automatic nozzle height adjustment arrangement, according to the preferred embodiment of the present invention.

Referring now to FIGS. 1 and 2, shown is a floor care appliance 10 which in the preferred embodiment is an upright vacuum cleaner. In alternate embodiments of the invention, floor care appliance 10 could be any type of floor care cleaner such as a canister cleaner, stick cleaner, carpet cleaner, or a bare floor cleaner. Upright vacuum cleaner 10 includes an upper housing assembly 200 pivotally connected to foot 100. Foot 100 is similar to those known in the art and includes a nozzle opening (not shown) for receiving a stream of dirt-laden air and an agitator (not shown) for agitating and loosening dust and debris from a floor surface when upright vacuum cleaner 10 is in the floor care mode. Foot 100 further includes a pair of front wheels (not shown) rotatably mounted on a wheel carriage (not shown), and a pair of rear wheels.

Located in foot 100 or upper housing 200 is a motor-fan assembly M2 which creates the suction necessary to remove the loosened dust and debris from the floor surface. The motor-fan assembly M2 fluidly connects to foot or suction nozzle 100 by a dirt duct (not shown). The upper housing assembly 200 houses a particle filtration and collecting system 300 for receiving and filtering the dirt-laden air stream which is created by the motor-fan assembly M2. The particle filtration and collecting system 300 may be interposed in the dirt laden air stream between the suction nozzle 100 and the motor-fan assembly M2 as in an "indirect air" system seen in FIG. 1 or the motor-fan assembly M2 may be interposed between the suction nozzle 100 and the particle filtration and collecting system 300 as in a "direct air" system. An independent electric agitator drive motor M1 is provided for providing rotary power for at least one rotary agitator (not shown) and an independent suction nozzle height adjustment motor M3 is provided for adjusting the height of the suction nozzle 100 relative to the floor surface. A switch SW1 is located on the handle for turning the motor-fan assembly on and off.

Referring now to FIG. 2, shown is an exploded view of a floor care appliance 10 with a preferred embodiment dirt collecting system 300. Dirt collecting system 300 generally includes a translucent dirt cup 350, a filter assembly 380 removably mounted within the dirt cup 350 and a dirt cup lid 382 which encloses the dirt cup 350. Filter assembly 380 generally includes an apertured wall 312, a filter support 314 extending from the apertured wall 312 and a primary filter member 381 which removably mounts on the filter support 314. The holes provide for fluid communication between the first dirt collecting chamber 316 and the second dirt collecting chamber 318. The apertured wall 312 functions as a coarse particle separator or pre-filter and could include any number of holes having various shapes (circular, square, elliptical, etc.), sizes and angles. To maximize airflow through the holes while still preventing large debris from passing therethrough, it is desirable to form the holes as large as 0.0036 square inches and as small as a 600 mesh screen. In the present embodiment, the holes in apertured wall 312 are circular with a hole diameter of approximately 0.030 inches. Further, the apertured wall should be formed with enough total opening area to maintain airflow through the dirt cup. It is desirable to form apertured wall 312 with a total opening area of between approximately 2.5 square inches to approximately 4 square inches. Complete details of the dirt collecting system 300 can be found in Hoover Case 2521, U.S. Pat. No. 6,596,044, owned by a common assignee and incorporated by reference fully herein. The suction nozzle height adjustment motor M3 suction nozzle height assembly 110 is also seen in FIG. 3.

Figure 3:
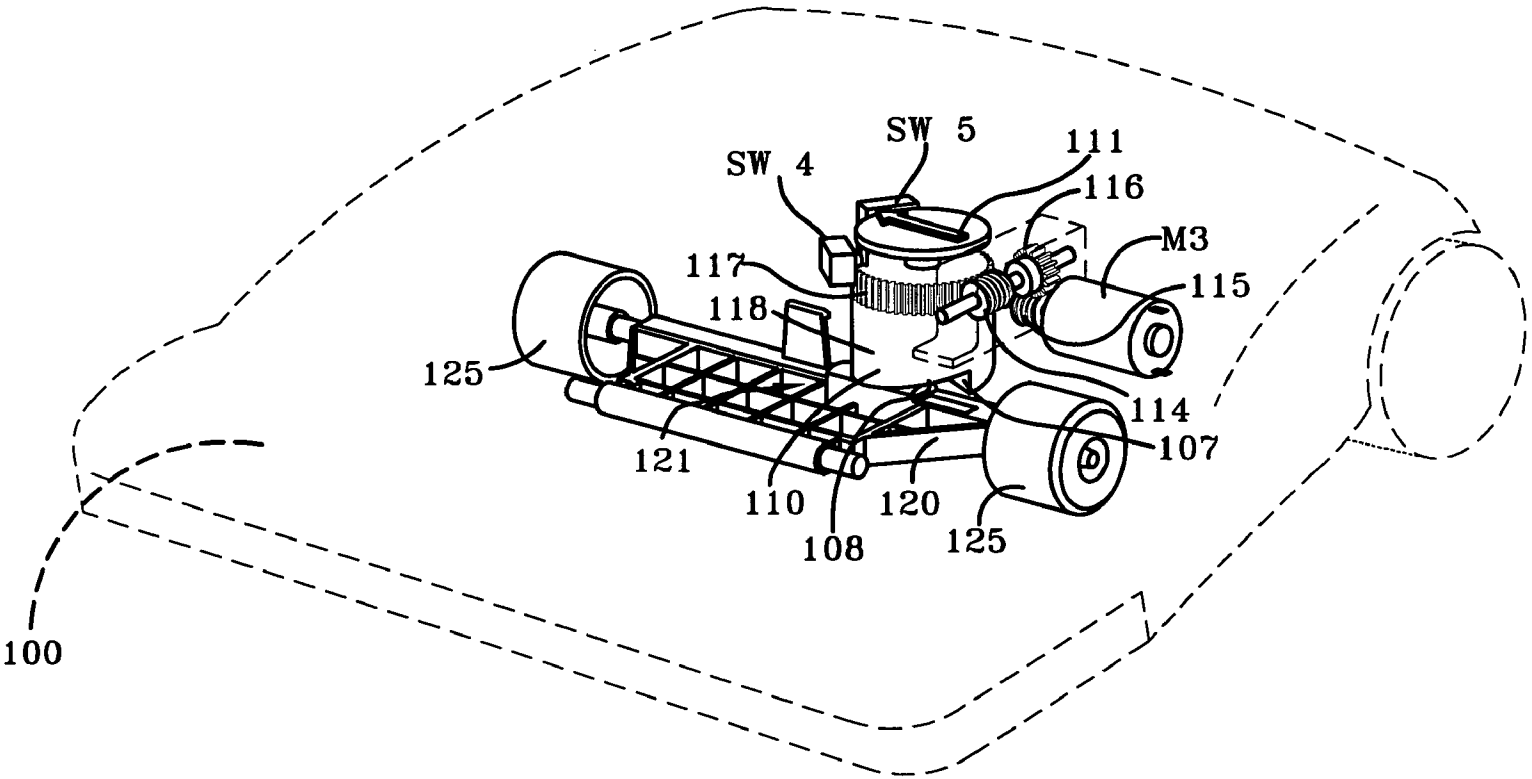
FIG. 3 is a perspective view of an electric motor driven height suction nozzle height adjustment assembly having travel limiter stops for turning off the height adjustment motor at the extremes of the suction nozzle height ranges, according to the preferred embodiment of the present invention.

Referring now to FIG. 3, shown is an outline of a suction nozzle 100 showing the suction nozzle height adjustment motor M3 and suction nozzle height adjustment arrangement 110. The suction nozzle height adjustment motor M3 raises and lowers the suction nozzle 100 when energized by the user pressing switch SW2 in either direction. The energized motor rotates worm gear 115 which rotates a second gear 116. This second gear 116 rotates a third gear 114 that engages gear teeth 117 on a cylindrical cam 118. Cylindrical cam 118 has a spiral cam portion 108 which engages a projection 121 on a wheel and carriage assembly 120. The spiral cam portion 108 bears against projection 121 urging the suction nozzle 100 upward as cylindrical cam 118 is rotated. Wheel and carriage assembly 120 has a pair of wheels 125 for contacting the floor surface and allowing suction nozzle 100 to be propelled over the floor surface. When cylindrical cam 118 is rotated in the opposition direction, spiral cam portion 108 releases pressure on projection 121 and gravity causes suction nozzle 100 to be lowered towards the floor surface. A stop 107 adjacent spiral cam portion 108 prevents further rotation of cylindrical cam 118 at the lowest height position of suction nozzle 100. To prevent damage to the suction nozzle height adjustment motor M3, a suction nozzle height adjustment travel limit cam arrangement 111 is located on the top end of cylindrical cam 118. The suction nozzle height adjustment travel limit cam 111 engages switch SW5 when suction nozzle 100 is lowered to the lowest height position and engages switch SW4 when suction nozzle 100 is raised to the highest height position to turn suction nozzle height adjustment motor M3 off to prevent overheating and over travel.

In an alternate embodiment of the present invention, there could be more than two switches SW4 and SW5 to interrupt power to the suction nozzle height adjustment motor M3 when any desired suction nozzle 100 height adjustment is reached. In yet another alternate embodiment, switches SW4 and SW5 are eliminated entirely and replaced with a potentiometer (not shown) to sense the position of the suction nozzle 100 and when a particular suction nozzle 100 height is reached, turn the current off to the suction nozzle height adjustment motor M3. In either of these embodiments and in the preferred embodiments, a conventional circuit could be used to control the suction nozzle height adjustment motor, or a microprocessor could be used.

Figure 4:
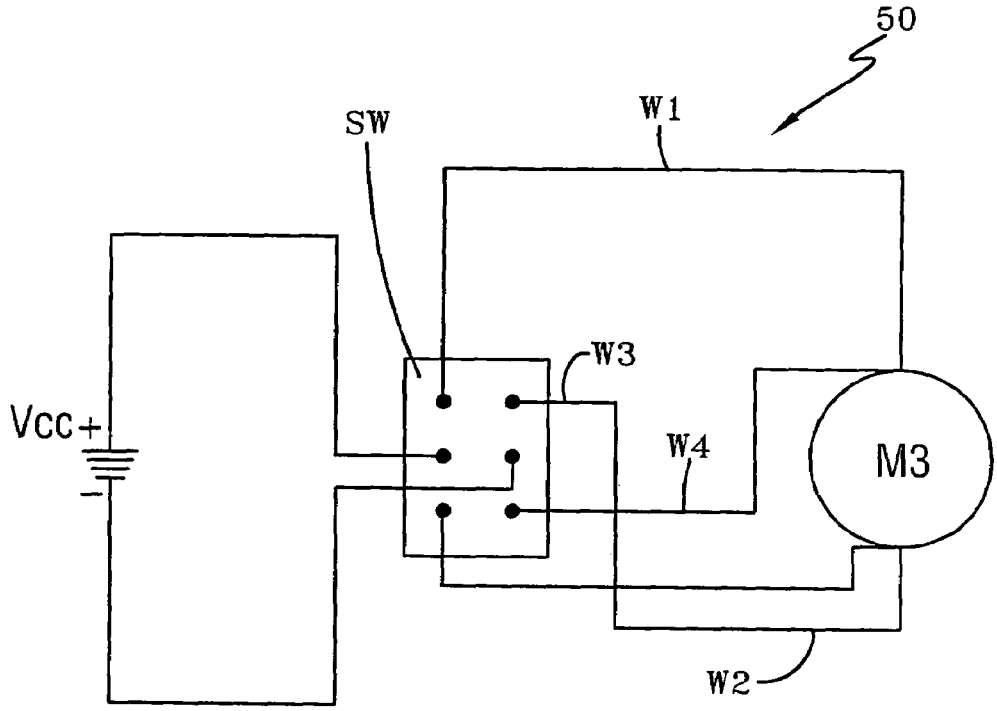
FIG-4 PRIOR ART
FIG. 4 is an electrical schematic of a prior art circuit for controlling an electric motor in both directions, according to the preferred embodiment of the present invention.

FIG. 4 shows a prior art circuit 50 for controlling a motor M3 in both directions through a double pole double throw (DPDT) switch SW and is powered by a power source Vcc. The switch SW is operatively connected to motor M3 by four wires W1, W2, W3 and W4 wherein two wires each are required to connect Vcc to motor M3 for each direction of travel of motor M3. In FIG. 4, Vcc is a direct current power source but an alternating current source could be used with an alternating current motor as well. Such a circuit 50 can typically be found in floor care appliances having a switch like switch SW2 located typically on the handle for raising and lowering the height of the suction nozzle 100 utilizing an independent electric height adjustment motor such as the floor care appliance 10 seen in FIGS. 1-2.

The operation of the preferred embodiment of the present invention utilizing only two wires for connecting the switch SW2 to motor M3 and controlling the operation of motor M3 in both directions is illustrated in FIGS. 5A through 5F and designated as circuit 55. Beginning with FIG. 5A, a switch SW2 is operatively connected to a suction nozzle height adjustment motor M3 and two wires W5 and W6. Limit switches SW4 and SW5 are located in a serial path along wire W5 each having a diode D1 and D2 respectively placed in parallel. When SW2 is closed in the direction of one pole as seen in FIG. 5A, current is applied to M3 because SW4 and SW5 are also closed. Motor M3 rotates in the direction of arrow 64. When the suction nozzle is at the extreme limit of travel in that direction, the cam 111 (FIG. 3) will cause SW5 to open (FIG. 5B) causing the current to motor M3 to be shut off. Power will not flow through diode D2 because it is biased on the opposite direction. As SW2 is moved to the opposite pole, as in FIG. 5C, opposite current in the direction of arrow 62 is applied to motor M3 and motor M3 is energized in the direction of arrow 65. Whereas current would not flow to motor M3 when switch SW5 was opened as seen in FIG. 5B, current now flows through to motor M3 because the current is flowing in the opposite direction as illustrated by arrow 62 through diode D2 which is now forward biased. After motor M3 has been momentarily energized, cam 111 is rotated away from switch SW5 and switch SW5 is now again closed and current is free to flow through SW5. The current will remain on as long as switch SW2 remains depressed. When the suction nozzle 100 height reaches the opposite extreme of travel, cam 111 depresses switch SW4 and switch SW4 opens shutting off the current to motor M3 as in FIG. 5E. The current will remain off until switch SW2 is switched to the opposite pole. Momentarily, the current flowing in the direction of arrow 61 will energize motor M3 in the direction of arrow 64 even though switch SW4 is still open as in FIG. 5F. The current can flow in the direction of arrow 61 because diode D1 is now forward biased and current can flow through it. Once cam 111 has rotated away from switch SW4, switch 4 closes and current can flow through SW4 to motor M3 (FIG. 5A). This cycle is repeated over and over as switch SW2 is depressed until the limit of suction nozzle height travel is reached and then released and depressed so that the suction nozzle height is then moved into the opposite direction.

Figure 6A:
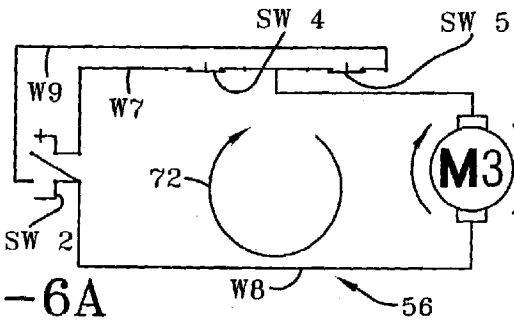
FIGS. 6A-6F show a circuit for controlling an electric motor in both directions for raising and lowering a suction nozzle utilizing three wires between the control switch and the electric motor, according to an alternate embodiment of the present invention.
Figure 6B:
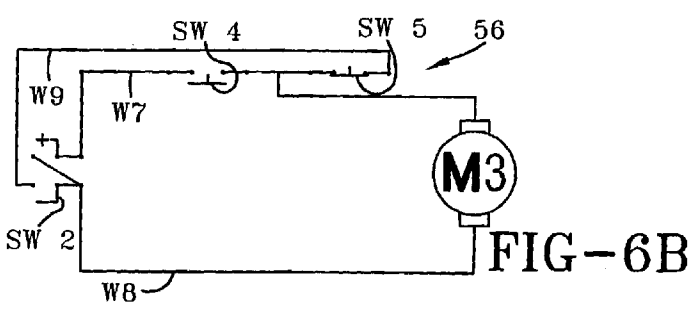
Figure 6C:
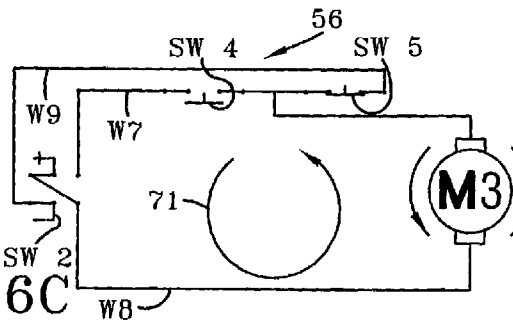
Figure 6D:
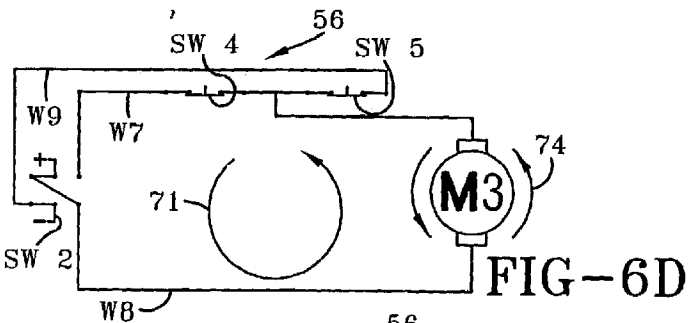
Figure 6E:
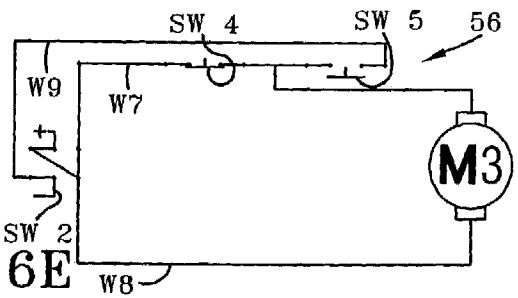
Figure 6F:
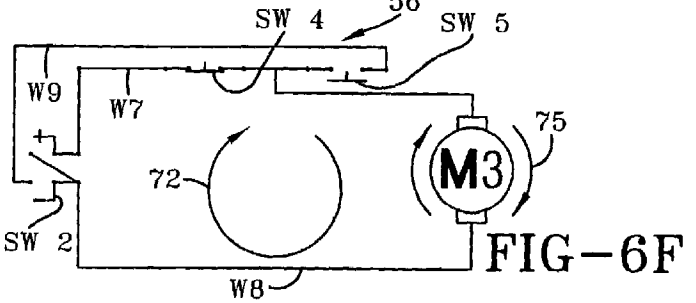

The operation of the alternate embodiment of the present invention utilizing three wires for connecting the switch SW2 to Motor M3 and controlling the operation of motor M3 in both directions is illustrated in FIGS. 6A through 6F and designated as circuit 56. Beginning with FIG. 6A, a switch SW2 is operatively connected to a suction nozzle height adjustment motor M3 and three wires W7, W8 and W9. Limit switch SW4 is located in a serial path along wire W7 and switch SW5 is located in a serial path along wire W9. When SW2 is closed in the direction of one pole as seen in FIG. 6A, current is applied in the direction of arrow 72 flowing through W7 and switch SW4 with the current being applied to motor M3. Motor M3 rotates in the direction of arrow 75 until the extreme limit of the suction nozzle height is reached in that direction and cam 111 (FIG. 3) opens switch SW4 and the current is interrupted (FIG. 6B). The current will remain off until switch SW2 is moved to the opposite pole and now current flows in the direction of arrow 71 through switch SW5 and wire W9 rotating motor M3 in the direction of arrow 74 (FIG. 6C). Once motor M3 has been momentarily energized, cam 111 (FIG. 3) releases switch SW4 and current now can flow through switch SW4 and wire W9 (FIG. 6D). As long as switch SW2 remains depressed, the current will remain on until the opposite extreme of suction nozzle height travel is reached and cam 111 (FIG. 3) will open switch SW5 (FIG. 6E). The current will remain off until switch SW2 is moved to the opposite pole allowing current to flow to motor M3 in the direction of arrow 72 through switch SW4 and wire W7 rotating motor M3 in the direction of arrow 75 (FIG. 6F). Once momentarily energized, cam 111 will be rotated away from switch SW5 causing switch SW5 to open and circuit 56 is fully returned to the state shown in FIG. 6A.

It should be clear from the foregoing that the described structure clearly meets the objects of the invention set out in the description's beginning. It should now also be obvious that many changes could be made to the disclosed structure which would still fall within its spirit and purview.

The invention claimed is:

1. A floor care appliance, comprising:

a suction nozzle capable of being raised and lowered in relation to a floor surface to be cleaned, said suction nozzle having a highest position of travel and a lowest position of travel;

an electric motor for raising and lowering the suction nozzle in relation to the floor surface to be cleaned;

a current source for the electric motor;

a first switch operatively connected to said electric motor for interrupting the current to said electric motor when said suction nozzle is moved to said highest position of travel; and a second switch operatively connected to said electric motor for interrupting the current to said electric motor when said suction nozzle is moved to said lowest position of travel.

2. The floor care appliance of claim 1, further comprising:

a suction nozzle height adjustment control switch for controlling the operation of the electric motor by allowing current to flow in a first direction when moved to a first position and allowing current to flow in a second direction when moved to a second position.

3. The floor care appliance of claim 2, wherein said suction nozzle height adjustment switch is located on a handle of the floor care appliance.

4. The floor care appliance of claim 2, further comprising:

two wires connecting said current source to said electric motor wherein said first switch and said second switch are placed in series in one of said two wires;

a first diode placed in parallel across said first switch; and a second diode placed in parallel across said second switch;

wherein said second diode allows current to flow from said current source to said electric motor in said second direction when said suction nozzle height adjustment control switch is moved from said first position to said second position and said first diode allows current to flow from said current source to said electric motor in said first direction when said suction nozzle height adjustment control switch is moved from said second position to said first position.

5. The floor care appliance of claim 2, further comprising:

three wires connecting said current source to said electric motor wherein said first switch and said second switch are placed in series in two of said three wires;

wherein when said first switch opens said current can flow from said current source to said electric motor in said second direction when said suction nozzle height adjustment control switch is moved from said first position to said second position and when said second switch said current can flow from said current source to said electric motor in said first direction when said suction nozzle height adjustment control switch is moved from said second position to said first position.

6. A method of controlling the height of an adjustable suction nozzle, comprising the steps of:

providing a suction nozzle;

providing an electric motor for raising and lowering the suction nozzle in relation to the floor surface to be cleaned;

providing a current source and supplying current from said current source to said electric motor;

providing a first switch operatively connected to said electric motor for interrupting the current to said electric motor when said suction nozzle is moved to a highest position of travel;

providing a second switch operatively connected to said electric motor for interrupting the current to said electric motor when said suction nozzle is moved to a lowest position of travel; and selectively operating said first and second switch to control the height of said suction nozzle.

7. The method of controlling the height of an adjustable suction nozzle of claim 6, further comprising the step of:

providing a suction nozzle height adjustment control switch for controlling the operation of the electric motor by allowing current to flow in a first direction when moved to a first position and allowing current to flow in a second direction when moved to a second position.

8. The method of controlling the height of an adjustable suction nozzle of claim 7, comprising the further step of providing said suction nozzle height adjustment control switch on a handle of the floor care appliance.

9. The method of controlling the height of an adjustable suction nozzle of claim 7, further comprising the steps of:

providing two wires connecting said current source to said electric motor wherein said first switch and said second switch are placed in series in one of said two wires;

providing a first diode placed in parallel across said first switch; and providing a second diode placed in parallel across said second switch;

wherein said second diode allows current to flow from said current source to said electric motor in said second direction when said suction nozzle height adjustment control switch is moved from said first position to said second position and said first diode allows current to flow from said current source to said electric motor in said first direction when said suction nozzle height adjustment control switch is moved from said second position to said first position.

10. The method of controlling the height of an adjustable suction nozzle of claim 7, further comprising the steps of:

providing three wires connecting said current source to said electric motor wherein said first switch and said second switch are placed in series in two of said three wires;

wherein when said first switch opens said current can flow from said current source to said electric motor in said second direction when said suction nozzle height adjustment control switch is moved from said first position to said second position and when said second switch said current can flow from said current source to said electric motor in said first direction when said suction nozzle height adjustment control switch is moved from said second position to said first position.

11. A floor care appliance, comprising:

a suction nozzle capable of being raised and lowered in relation to a floor surface to be cleaned, said suction nozzle having a highest position of travel and a lowest position of travel;

an electric motor for raising and lowering the suction nozzle in relation to the floor surface to be cleaned;

a current source for the electric motor; and a potentiometer operatively connected to said electric motor and said current source for sensing the height of said suction nozzle and for interrupting the current to said electric motor when said suction nozzle is moved to said highest position of travel and said lowest position of travel.

12. A floor care appliance, comprising:

a suction nozzle capable of being raised and lowered in relation to a floor surface to be cleaned, said suction nozzle having a highest position of travel and a lowest position of travel;

an electric motor for raising and lowering the suction nozzle in relation to the floor surface to be cleaned;

a current source for the electric motor; and at least two switches operatively connected to said electric motor and said current source for sensing the height of said suction nozzle and for interrupting the current to said electric motor when said suction nozzle is moved to said highest position of travel and said lowest position of travel.

* * * * *